US006234352B1

(12) United States Patent
Richard et al.

(10) Patent No.: US 6,234,352 B1
(45) Date of Patent: May 22, 2001

(54) METHOD AND APPARATUS TO REDUCE FRACTIONATION OF FLUID BLEND DURING STORAGE AND TRANSFER

(75) Inventors: Robert G. Richard; Rajiv Ratna Singh, both of Erie County, NY (US); H. Michael Hughes, Hart County, GA (US)

(73) Assignee: AlliedSignal Inc., Morristown, NJ (US)

( * ) Notice: Subject to any disclaimer, the term of this patent is extended or adjusted under 35 U.S.C. 154(b) by 0 days.

(21) Appl. No.: 09/371,319

(22) Filed: Aug. 10, 1999

Related U.S. Application Data

(60) Provisional application No. 60/095,956, filed on Aug. 10, 1998.

(51) Int. Cl.[7] ..... B65D 35/00

(52) U.S. Cl. ..... 222/95; 222/4; 222/94; 222/105; 222/107; 222/386.5

(58) Field of Search ..... 222/3, 4, 1, 94, 222/95, 105, 107, 386.5

(56) References Cited

U.S. PATENT DOCUMENTS

| | | | | |
|---|---|---|---|---|
| 3,213,913 | | 10/1965 | Petriello . | |
| 3,592,360 | | 7/1971 | Aleck | 222/95 |
| 3,656,657 | | 4/1972 | Smith et al. | 222/4 |
| 3,883,046 | | 5/1975 | Thompson et al. | 222/386.5 |
| 3,979,025 | | 9/1976 | Friedrich et al. | 222/95 |
| 4,085,856 | | 4/1978 | Thompson et al. | 222/1 |
| 4,193,514 | * | 3/1980 | Langstroth | 222/4 |
| 4,265,373 | | 5/1981 | Stoody | 222/94 |
| 4,383,399 | | 5/1983 | Stoody | 53/470 |
| 4,459,865 | | 7/1984 | Welker . | |
| 4,463,599 | | 8/1984 | Welker . | |
| 4,752,018 | | 6/1988 | Rudick et al. | 222/1 |
| 4,846,364 | | 7/1989 | Boe . | |
| 4,867,344 | * | 9/1989 | Bitterly | 222/94 |
| 5,022,442 | * | 6/1991 | Bird | 141/100 |
| 5,032,619 | * | 7/1991 | Frutin et al. | 222/386.5 |
| 5,277,336 | | 1/1994 | Youel | 222/105 |
| 6,050,310 | * | 4/2000 | Trigiani | 141/18 |

FOREIGN PATENT DOCUMENTS

| | | |
|---|---|---|
| 0 790 411 | 8/1997 | (EP) . |
| 804500 | 11/1958 | (GB) . |

OTHER PUBLICATIONS

American Society of Heating, Refrigerating and Air–Conditioning Engineers, Inc., CFCs: Today's Options—Tomorrow's Solutions, Sep. 27–28, 1989 pp. 57–69.

* cited by examiner

*Primary Examiner*—J. Casimer Jacyna
(74) *Attorney, Agent, or Firm*—Colleen D. Szuch; Marie Collazo

(57) ABSTRACT

A method and apparatus for storing and dispensing in liquid form a blend of fluids which normally fractionate upon boiling. The apparatus includes a container having an internal bladder dividing the container into two chambers. The first chamber contains the liquid blend, and the second chamber contains a pressurizing fluid in sufficient quantity to maintain the pressure on the other side of the bladder in the first chamber above the bubble point pressure of the liquid blend. In this manner, the vapor space above the fluid blend is eliminated, and thus the effect of fractionation caused by vaporization is essentially eliminated during dispensing or leakage of the blend from the package.

22 Claims, 2 Drawing Sheets

METHOD AND APPARATUS TO REDUCE FRACTIONATION OF FLUID BLEND DURING STORAGE AND TRANSFER

RELATED APPLICATIONS

This application claims the benefit of U.S. Provisional Application No. 60/095,956, filed Aug. 10, 1998.

FIELD OF THE INVENTION

This invention relates to a method and apparatus for reducing fractionation of fluid blends during dispensing or leakage of the blend from a container, and more particularly to a container for refrigerant blends which permits storage and transfer of the refrigerant blend with reduced fractionation.

BACKGROUND OF THE INVENTION

Chlorofluorocarbons (CFCs) and hydrochlorofluorocarbons (HCFCs) have many uses, one of which is as a refrigerant. In recent years it has been pointed out that certain CFC and HCFC refrigerants released into the atmosphere may adversely affect the stratospheric ozone layer. Accordingly, there is a demand for the development of refrigerants that have a lower ozone depletion potential than existing refrigerants while still achieving an acceptable performance in refrigeration applications. Hydrofluorocarbons (HFCs) have been suggested as replacements for CFCs and HCFCs because HFCs, which have no chlorine, have been found to have no ozone depletion potential.

The air conditioning industry has looked to find environmentally acceptable refrigerants to replace CFCs and HCFCs in refrigeration applications. Ideally, replacement refrigerant compositions should have the same thermodynamic properties as the composition being replaced, as well as chemical stability, low toxicity, non-flammability and efficiency-in-use. Unfortunately, single component replacement refrigerants are often unable to provide all of the desired properties. In order to match the properties of the refrigerants being replaced, blends of environmentally acceptable refrigerants have been developed to achieve the best possible performance, capacity, efficiency and safety, as well as minimal cost.

When a liquid is heated above its boiling point, it becomes a vapor, and when a vapor is cooled below its condensation point, it becomes a liquid. For pure, single component fluids the boiling point and condensation point temperatures at a given pressure are the same, and the composition of such a fluid is the same in its vapor and liquid states. Fluids can also change state due to a change of pressure. When the pressure on a liquid is lowered below the vaporization pressure it becomes a vapor, and when the pressure is increased above its condensation pressure, it becomes a liquid. For a pure, single component fluid the vaporization and condensation point pressures at a given temperature are the same, and the composition of such a fluid remains constant.

However, for blends of fluids having different thermodynamic properties, such as refrigerant blends, the relationship between vaporization and condensation is more complex. In such fluid mixtures, boiling or condensation may occur over a range of temperatures rather than at a single fixed point. For example, for non-azeotropic blends (also referred to as zeotropic blends) as the temperature of such a fluid mixture in liquid state is raised, the lower boiling-point components boil off preferentially. The point at which the liquid first begins to vaporize is referred to as the bubble point, i.e. the point at which bubbles first form. The bubble point can be expressed as the temperature above which a constant pressure liquid begins to vaporize, or it can be expressed as the pressure below which a constant temperature liquid begins to vaporize, also referred to as the bubble point pressure. Conversely, for such a blend in vapor state, as the temperature of the vapor is lowered, the highest condensation temperature components begin to condense first. The point at which vapor first begins to condense is referred to as the dew point. The dew point can be expressed as the temperature below which a constant pressure vapor begins to vaporize, or it can be expressed as the pressure above which a constant temperature vapor begins to condense, also referred to as the dew point pressure. Thus, a fluid blend begins to vaporize at its bubble point, and completes the vaporization at its dew point, and vice versa.

Because of the different boiling points of the components of such blends, the fluids tend to segregate or fractionate during boiling. That is, as the temperature increases, the lower boiling point components vaporize preferentially. This results in the vapor having a higher concentration of the lower boiling components than the liquid, and a lower concentration of the higher boiling components. This effect is referred to as segregation or fractionation. As a result, when such a fluid blend is stored in a closed container in which there is a vapor space above a quantity of liquid, the composition of the vapor is different from that of the liquid. When such blends are withdrawn or leak from the container in which they are stored, fractionation can take place, with accompanying changes in composition. This effect is demonstrated in the Example set forth below. Composition changes of the mixture can be quite significant, and even relatively small composition changes cannot be tolerated in certain circumstances. Such changes can cause a refrigerant to have a composition outside of specified limits, to have different performance properties or even to become hazardous, such as by becoming flammable.

The range between the bubble and dew points is often referred to as the "glide".

A refrigerant blend may be considered to have a "high glide" if the range from the bubble point to the dew point is greater than about 1° F. (about 0.5° C.) at constant pressure. The problem of fractionation is a particular problem for high-glide refrigerants because of the greater tendency of the low and high boiling point components to segregate. On the other hand, pure single component fluids have zero glide. The composition of the initial vapor is the same as that of the final vapor as the liquid boils off. Therefore, they do not experience the compositional changes of high-glide fluid blends during vaporization.

In the refrigeration industry, refrigerant blends often need to be added to equipment in the field. However, it has been particularly difficult to dispense such blends from existing containers due to the problem of fractionation. There is a recognized need for a portable container or package capable of storing and dispensing such fluid blends, particularly high-glide refrigerant blends, while maintaining the blend's components in substantially uniform proportions.

ASHRAE (American Society of Heating, Refrigeration and Air Conditioning Engineers) has recognized these problems and has tried to examine the effect of the shift in composition and to evaluate blends accordingly. For example, a detailed discussion of 20 such blends may be found in Didion, et al., "The Role of Refrigerant Mixtures as Alternatives", pages 57–69, *Proceedings of ASHRAE's* 1989 *CFC Technology Conference*, Sep. 27–28,1989, incorporated herein by reference. A difficulty that has recently gained recognition is that even during normal use, when the refrigerant is dispensed as a liquid, fractionation can change the refrigerant blend composition 25 sufficiently that the blend will no longer be within the tolerance set in the evaluation.

This problem has been observed for refrigerant blends such as R-407C and R-409A. To a lesser extent even R-410A and R-507 also show some composition shifts during use. The problem is even more pronounced when the refrigerant leaks from a container in vapor form. As previously indicated, the effects of fractionation are demonstrated by the Example set forth below.

The composition as well as data and safety classifications of refrigerant blends are set forth in Table 2 of ANSI/ASHRAE Standard 34-1997, incorporated herein by reference. The four above-identified blends are listed as having the following nominal compositions (weight percentages):

| | | |
|---|---|---|
| R-407C | R-32/125/134a | 23/25/52 |
| R-409A | R-22/124/142b | 60/25/15 |
| R-410A | R-32/125 | 50/50 |
| R-507 | R-125/143a | 50/50 |

It may be noted that R-507 is identified in the Standard as being azeotropic, which would mean that the fluid has a low glide, and that the liquid and vapor have the same composition when in equilibrium. However, it has been observed that at some conditions of temperature and pressure R-507 shows fractionation. Therefore, this blend, as well as 10 others listed as being azeotropic, may be subject to fractionation at certain conditions of temperature and pressure.

One way to prevent fractionation is to have only one phase present in a cylinder containing a refrigerant blend. This presents several problems. If a rigid cylinder were filled with only liquid, an increase in temperature could cause it to rupture due to static 15 pressure. Conversely, if the temperature of the liquid were decreased, a vapor space would have to form above the liquid, or the cylinder would have to contract. If only vapor were used, the volume of the cylinder would have to be so large it would not be practical.

Another practice to prevent fractionation is to employ single-use packaging. That is, the cylinder contains the exact quantity of material needed for one application and the contents are exhausted in that single use. This is not practical in the air conditioning and refrigeration industry due to the wide variety of equipment and charge sizes required. The number of differently sized packages that would be necessary would be too large to stock and manage economically.

Yet another method is to remove only liquid from the cylinder. This causes far less fractionation than removing vapor but the composition can still shift to an unacceptable degree, as demonstrated by the Example set forth below. One improvement on this method entails mixing some vapor with the liquid as it is removed using a perforated dip tube as described in U.S. Patent No. 3,656,657. This method is not used widely, probably due to its dependency on flow rate.

Accordingly, it is an object of the invention to provide a method and apparatus for storing and dispensing a blend of fluids having different thermodynamic properties without the composition changing.

Other objects and advantages of the invention will become apparent from the following description of the invention.

DETAILED DESCRIPTION OF THE INVENTION

In accordance with the present invention the problem of the fractionation of blends of fluids having different thermodynamic properties, particularly refrigerant blends, is overcome by providing a variable volume package employing a bladder in cylinder arrangement. The method and apparatus make use of a container with an elastic bladder disposed therein by which a pressurizing fluid on one side of the bladder maintains a fluid blend on the other side of the bladder in liquid state at a pressure above its bubble point. By placing the refrigerant on one side of a bladder in a cylinder and a higher-pressure pressurizing fluid on the other side of the bladder, the vapor space above the refrigerant can be eliminated. Because the mass of vapor present in prior art packages is essentially eliminated in the present invention, the effect of different vapor and liquid compositions is effectively overcome. The flexible bladder-in-cylinder arrangement accomplishes this if the pressure applied to the bladder by the pressurizing fluid is greater than the bubble point pressure of the refrigerant blend. A further advantage of this package is that the liquid refrigerant can be dispensed with the package in any orientation without affecting the composition of the refrigerant.

Figure 1:
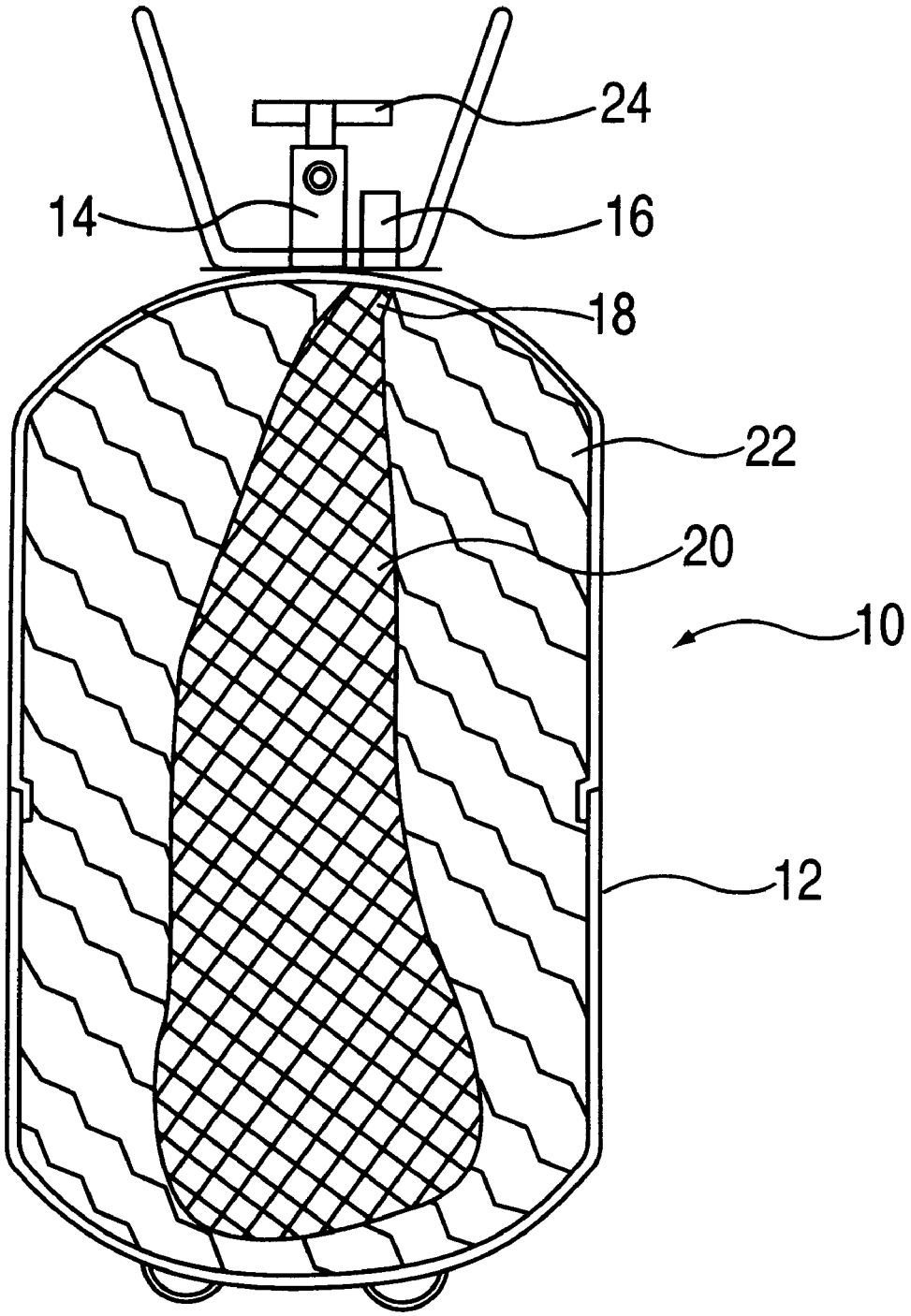
FIG. 1 is a cutaway view of a package for containing and dispensing refrigerant blends in accordance with a first embodiment of the present invention.

FIG. 1 depicts a first embodiment of a package for containing and dispensing refrigerant blends in accordance with the present invention. Package 10 generally includes a closed cylinder or pressure container 12 having a refrigerant port 14 and a pressurizing port 16 disposed therein. In this embodiment, a bladder 18 is connected to the pressurizing port 16 to permit charging of a pressurizing fluid 20 into the bladder.

Refrigerant port 14 permits the charging and discharging of refrigerant 22 to and from the space between the bladder 18 and the inside wall of cylinder 12. Refrigerant port 14 preferably includes a valve 24 to control flow of the refrigerant.

In this embodiment, bladder 18 contains the pressurizing fluid 20 and the refrigerant blend 22 is in the space between the outside of the bladder and the inside of the cylinder. As the refrigerant is removed from the cylinder the bladder expands filling the void of the leaving refrigerant and maintaining the pressure required to prevent any vapor from forming above the refrigerant.

Figure 2:
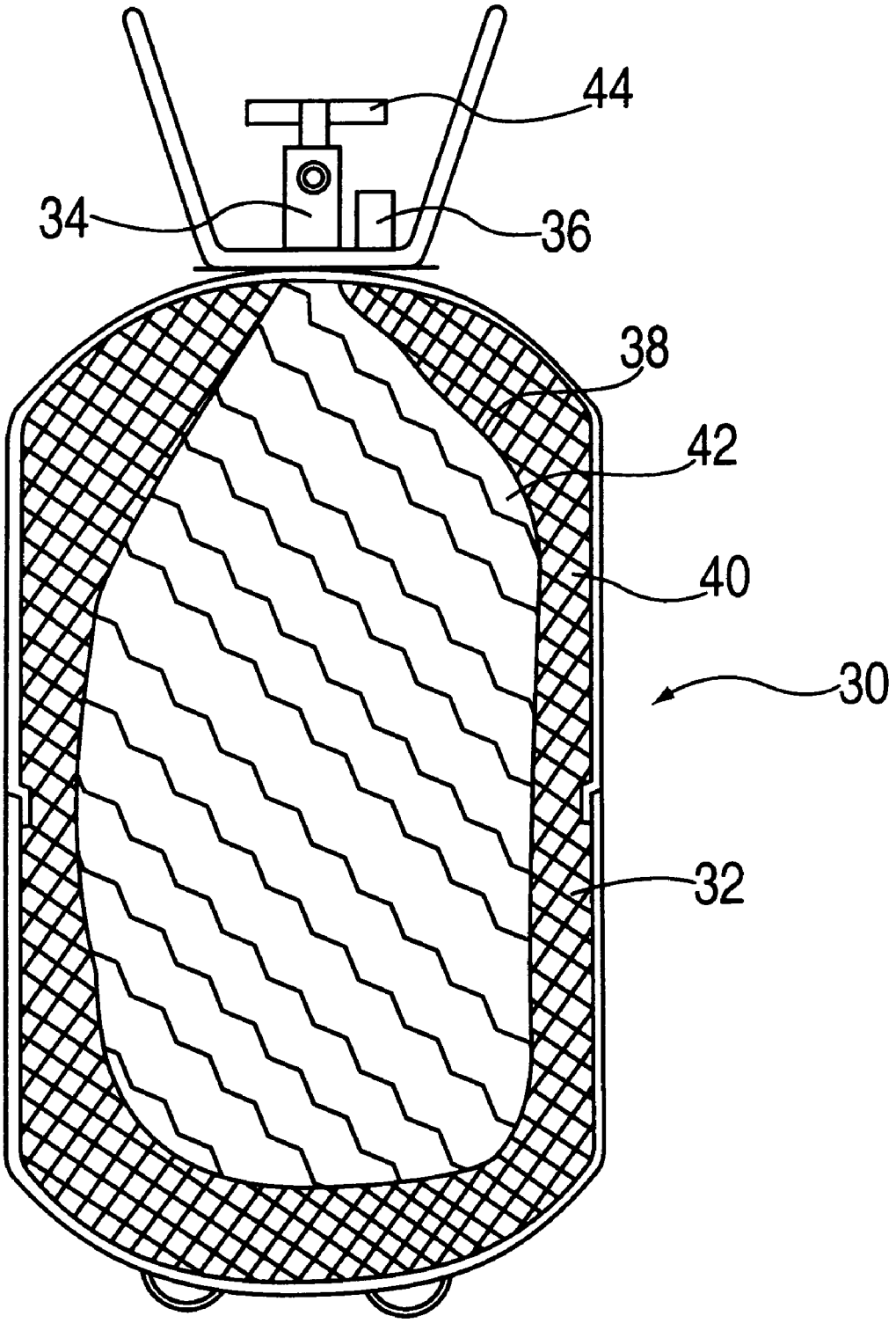
FIG. 2 is a cutaway view of a package for containing and dispensing refrigerant blends in accordance with a second embodiment of the present invention.

FIG. 2 depicts a second embodiment of a package for containing and dispensing refrigerant blends in accordance with the present invention. Package 30 generally includes a closed cylinder or pressure container 32 having a refrigerant port 34 and a pressurizing port 36 disposed therein. In this embodiment, a bladder 38 is connected to the refrigerant port 34 to permit charging and discharging of refrigerant 42 to and from the bladder. Pressurizing port 36 permits the charging of a pressurizing fluid 40 to the space between the bladder 38 and the inside wall of cylinder 32. Refrigerant port 34 preferably includes a valve 44 to control flow of the refrigerant.

In this embodiment, bladder 38 contains the refrigerant blend 42 while the higher-pressure pressurizing fluid 40 is charged to the space between the bladder and the cylinder wall. As the refrigerant is dispensed the bladder collapses keeping the liquefied refrigerant under pressure and preventing any vapor from forming above the refrigerant.

In both embodiments, the concept is to prevent the formation of a vapor space above the liquid refrigerant, thereby providing for dispensing of a uniform liquid refrigerant blend with no change to the blend composition. As refrigerant is removed from the cylinder the volume of liquid decreases. By using a bladder in accordance with the present invention, the refrigerant blend remains uniformly liquid. This overcomes the problem of composition change resulting from formation of a vapor phase. The bladder also prevents the high-pressure fluid from mixing with the refrigerant.

The apparatuses illustrated in FIGS. 1 and 2 show a container divided by a single bladder into two chambers, with each chamber in fluid communication with a port. It is also within the scope of the present invention to provide an apparatus comprising multiple bladders which divide the container into multiple chambers, with each chamber in fluid communication with a port. In this manner, n bladders would divide a container into n+1 chambers. The chambers could contain the same or different fluids, as desired. For example, a multi-bladder apparatus could have different refrigeration fluids in different chambers, provided that the pressure on those chambers which contain zeotropic refrigerant blends is kept above the bubble point pressure of those blends. In this manner, a service technician could carry a variety of refrigerants in a single tank. Alternatively, multiple chambers of pressurizing fluids could be provided. This could be useful to ensure maintenance of pressure if one bladder should leak, or to maintain pressure in a large or unusually configured container.

The method of the present invention can be described generally as a method for containing and dispensing in liquid form a blend of fluids which fractionate upon vaporization, in which the method comprises charging the blend of fluids into the first chamber of a container which has an elastic bladder dividing the container into first and second chambers, and charging a pressurizing fluid the second chamber to maintain the pressure in said first chamber above the bubble point pressure of said liquid.

In a more general sense, the present invention provides a container for storing and dispensing in liquid form a blend of fluids which fractionate upon vaporization, the container comprising means to prevent formation of a vapor space above the liquid blend during storage and dispensing. The means to prevent formation of a vapor space preferably comprises an elastic bladder disposed in the container dividing the container into first and second chambers, wherein the liquid blend is contained within the first chamber and a pressurizing fluid is contained within the second chamber, and wherein the pressurizing fluid is provided in sufficient quantity to prevent formation of a vapor space above the liquid blend in the first chamber.

The high-pressure pressurizing fluid can be a compressed gas or a liquefied gas as long as the pressure is greater than the bubble point pressure of the refrigerant blend. The pressurizing fluid can be a single fluid, or a blend of fluids. Preferably, a pressurizing material is chosen which would not be detrimental to the refrigerant blend if the bladder leaks. In this case, a fluid is considered detrimental if would adversely affect the pressurized product in its intended application. For example, for refrigerants the pressurizing fluid should be chemically compatible and stable, and not adversely change the thermodynamic properties of the refrigerant blend. The pressurizing fluid should have a vapor pressure greater than bubble point of the refrigerant blend, preferably just slightly greater than the bubble point. One means to achieve this is by using a pressurizing fluid which is close to the composition of the refrigerant blend, particularly one which would be close to the composition of the vapor which would be in equilibrium with the refrigerant blend if there were a vapor space above the liquid. The composition of such a pressurizing fluid can be estimated based on the composition of the refrigerant blend, or can be determined empirically by analyzing the vapor bled from a tank containing the blend, as in the Example below. In one embodiment of the present invention, a pressurizing fluid is used which consists essentially of one or more of the fluids in the refrigerant blend, preferably with a greater amount of the lower boiling components. A particularly preferred embodiment uses one or more of the lower boiling components of the refrigerant blend as the pressurizing fluid. For example, with R-407C (comprising R-32/125/134a), R-32 or R-410A (comprising R-32/125) may be used as the pressurizing fluid. For R-409A (comprising R-22/124/142b), R-22 or R-22/124 mixtures may be used, preferably with a minimum of about 30% R-22.

Preferably, the quantity of pressurizing fluid used is at least that which would fill the cylinder without any refrigerant in it while still having a pressure greater than the bubble pressure of the refrigerant blend which is being contained. That is, the quantity of high-pressure fluid is calculated such that the pressure in the cylinder after the refrigerant is fully expelled and the bladder is fully collapsed is greater than or equal to the refrigerant blend's bubble pressure. For example, R-407C has a bubble point pressure of 155 psia at 70° F. R-32 can be used to expel R-407C because its saturated pressure is 220 psia. For a 30-pound water capacity (WC) cylinder, 0.8 pounds of R-32 could be used, based on its density of 1.675 lb/ft$^3$ at 155 psia.

In the package of the present invention shown in FIGS. 1 and 2, the bladder is a flexible membrane forming a sack which is sealed at its opening to either the refrigerant or pressurizing port. The bladder may be sealed to the port by flanges, ferules, crimping or other well-known attachment methods. The bladder can be made of any suitable flexible material such as, without limitation, tetrafluoroethylene (TFE;), polypropylene, neoprene, buna N (nitrile), latex, natural rubber, fluorosilicone, silicone, polyurethane, nylon, Viton® copolymers or ethylene propylene rubber (EPR). A key point is that the material must be chemically non-reactive with both the refrigerant and the pressurizing fluid. Preferably, the bladder material is non-permeable, or at least permeable to less than one gram of high pressure fluid or refrigerant per year under operating conditions. The bladder should be flexible enough to be able to fill the cylinder completely, and to remain flexible over the range of operating temperatures which may range from about −20° F. (−30° C.) to about 130° F. (55° C.). The bladders may be formed in much the same way as balloons or the bladders used in pressurized water tanks.

Bladder materials can readily be tested for life and durability. In a simple test, a sample of a proposed bladder material is weighed and measured. The sample is then sealed in an autoclave that is charged with a test fluid at a selected temperature and pressure. After a period of time, the samples are removed, and weighed and measured. Samples which do not shrink or swell more than about ±10% and whose weight does not change more than about ±10% would be considered to have reasonable durability.

The cylinder can be made of any rigid material that is chemically non-reactive with the refrigerant and the pressurizing fluid, and able to contain the materials at operating temperatures and pressures. Such cylinders are commercially available from many sources, and may be made from metals such as, without limitation, steel, stainless steel, nickel alloys or aluminum.

The refrigerant and pressurizing fluid can be charged to the package in any order. That is, the refrigerant can be charged first, the pressurizing fluid can be charged first, or they can be charged simultaneously.

Although it is preferred to maintain the refrigerant blend in the container completely in liquid form, a small amount of vapor may be present above the liquid. Preferably, the vapor space is less than 10 percent of the liquid volume, more preferably less than 1 percent, and most preferably zero percent of the liquid volume. Such a vapor phase may comprise non-condensable gases, as well as components of the blend. Care should be taken to avoid drawing off such vapor when dispensing the liquid blend. In such apparatus, it may be necessary to use a dip tube or some other means to draw only from the liquid portion of the fluid.

The apparatus illustrated in FIGS. 1 and 2 shows one port for the refrigerant chamber and one for the pressurizing fluid chamber, with both ports situated on top of the container. One skilled in the art should recognize that other configurations are possible, and these are considered to be within the scope of the present invention. For example, the two ports could be located on different parts of the container. That is, one port could be on top and the other on the bottom, or the ports could be on different sides of the container. In such constructions the bladder could be attached to one of the ports as illustrated in FIGS. 1 and 2. Alternatively, the bladder could be mounted to the inside of the container in a manner to divide the container into two chambers. The key is that the bladder needs to be able to permit the pressurizing fluid in the first chamber to maintain the pressure in the second chamber above the bubble point of the liquid blend, and to eliminate substantially any vapor space above the liquid blend.

Another possible alternative embodiment is to have separate filling and dispensing ports to one or both of the chambers in the container. For example, it may be desirable to provide a container that allows make-up liquid blend to be added to the container through one port while drawing off liquid from another port.

EXAMPLE

This example demonstrates the fractionation of a high-glide refrigerant fluid (R407-C) resulting from the discharge of the refrigerant from a container. R-407C with a starting composition of R-32/125/134a (22.6/23.3/54.1 wt. %) is charged to atypical refrigerant jug. The fluid is released from the jug over a period of time as either a liquid, comparable to normal dispensing, or as a vapor, comparable to a vapor leak. As the refrigerant blend is removed from the jug, the composition of the remaining liquid in the jug is monitored. The composition of the remaining liquid as the fluid is bled off as a vapor is set forth in Table 1. The composition of the remaining liquid as the fluid is discharged as a liquid is set forth in Table 2. From the data set forth in Table 1, it can be seen that a vapor leak would leave a final composition of 1.9/3.2/94.9 wt. % R-32/125/134a, while liquid removal causes a composition shift to 21.4/22.4/56.2 wt. % R-32/125/134a. In contrast to the results set forth in Tables 1 and 2, when such a fluid is discharged from a container in accordance with the present invention, no vapor space forms above the liquid refrigerant, and there is no change in the composition of the liquid.

TABLE 1

R-407C Vapor bleed @ 70° F.

| Bleed wt. % | R-32 wt. % | R-125 wt. % | R134a wt. % |
|---|---|---|---|
| 0.0 | 22.6 | 23.3 | 54.1 |
| 2.0 | 22.4 | 23.1 | 54.5 |
| 10.0 | 21.5 | 22.5 | 56.0 |
| 20.0 | 20.2 | 21.6 | 58.2 |
| 30.0 | 18.8 | 20.6 | 60.6 |
| 40.0 | 17.3 | 19.3 | 63.4 |
| 50.0 | 15.5 | 17.9 | 66.6 |
| 60.0 | 13.4 | 16.1 | 70.5 |
| 70.0 | 11.0 | 13.8 | 75.2 |
| 80.0 | 8.1 | 10.9 | 81.0 |
| 90.0 | 4.6 | 6.9 | 88.5 |
| 95.0 | 2.7 | 4.4 | 92.9 |
| 97.2 | 1.9 | 3.2 | 94.9 |

TABLE 2

R-407C Liquid discharge at 70° F.

| Bleed wt. % | R-32 wt. % | R-125 wt. % | R134a wt. % |
|---|---|---|---|
| 0 | 22.6 | 23.3 | 54.1 |
| 2 | 22.6 | 23.3 | 54.1 |
| 10 | 22.5 | 23.3 | 54.2 |
| 20 | 22.5 | 23.2 | 54.3 |
| 30 | 22.4 | 23.2 | 54.4 |
| 40 | 22.4 | 23.2 | 54.5 |
| 50 | 22.3 | 23.1 | 54.6 |
| 60 | 22.2 | 23.1 | 54.7 |
| 70 | 22.1 | 23.0 | 54.9 |
| 80 | 22.0 | 22.9 | 55.1 |
| 90 | 21.7 | 22.7 | 55.6 |
| 95 | 21.5 | 22.5 | 56.0 |
| 96.13 | 21.4 | 22.4 | 56.2 |

What is claimed is:

1. Apparatus for containing and dispensing in liquid form a blend of fluids which fractionate upon vaporization, the apparatus comprising a pressure container, first and second ports in said container, and an elastic bladder disposed in the container dividing the inside of the container into first and second chambers with the bladder therebetween, each chamber being in fluid communication with one of the respective ports;

wherein said first chamber contains said liquid blend, and said second chamber contains a pressurizing fluid in sufficient quantity to maintain the pressure on the other side of the bladder in said first chamber above the bubble point pressure of the liquid blend.

2. The apparatus of claim 1 further comprising at least one additional port and bladder dividing the inside of the container into at least one additional chamber, wherein the at least one additional chamber is in fluid communication with the at least one additional port.

3. The apparatus of claim 1 wherein the pressurizing fluid is one which would not be detrimental to the blend if it leaked into the blend.

4. The apparatus of claim 3 wherein the pressurizing fluid consists essentially of one or more of the fluids of said blend.

5. The apparatus of claim 4 wherein the pressurizing fluid consists essentially of one or more of the lower boiling point fluids of said blend.

6. The apparatus of claim 3 wherein the pressurizing fluid is substantially of the same composition as vapor which would be in equilibrium with said blend.

7. The apparatus of claim 1 wherein said blend is a blend of refrigerants having a high glide.

8. The apparatus of claim 1 wherein said bladder forms a closed sack sealed to and in fluid communication with one of said ports.

9. The apparatus of claim 8 wherein said liquid blend is contained within said closed sack.

10. The apparatus of claim 8 wherein said pressurizing fluid is contained within said closed sack.

11. The apparatus of claim 1 further comprising a valve on one of said ports for dispensing said blend.

12. The apparatus of claim 1 wherein the second chamber contains the pressurizing fluid in sufficient quantity to maintain the pressure in the second chamber above the bubble point pressure of the liquid blend when the liquid blend is fully dispensed from the container.

13. A method for containing and dispensing in liquid form a blend of fluids which normally fractionate upon boiling comprising:

a) providing an apparatus comprising a pressure container, first and second ports in said container, and a flexible, elastic bladder disposed in the container dividing the inside of the container into first and second chambers with the bladder therebetween, each chamber being in fluid communication with a port;

b) charging, in any order, said blend into said first chamber and a pressurizing fluid into said second chamber, wherein a sufficient quantity of said pressurizing fluid is provided in said second chamber to maintain the pressure in said first chamber above the bubble point pressure of the liquid blend.

14. The method of claim 13 wherein said apparatus further comprises at least one additional port and bladder dividing the inside of the container into at least one additional chamber, wherein the at least one additional chamber is in fluid communication with the at least one additional port.

15. The method of claim 13 wherein the pressurizing fluid is one which would not be detrimental to the blend if it leaked into the blend.

16. The method of claim 15 wherein the pressurizing fluid consists essentially of one or more of the fluids of said blend.

17. The method of claim 16 wherein the pressurizing fluid consists essentially of one or more of the lower boiling point fluids of said blend.

18. The method of claim 15 wherein the pressurizing fluid is substantially of the same composition as vapor which would be in equilibrium with said blend.

19. The method of claim 13 wherein said blend is a blend of refrigerants having a high glide.

20. The method of claim 13 wherein said bladder forms a closed sack sealed to and in fluid communication with one of said ports.

21. The method of claim 13 wherein the second chamber contains the pressurizing fluid in sufficient quantity to maintain the pressure in the second chamber above the bubble point pressure of the liquid blend when the liquid blend is fully dispensed from the container.

22. A method for containing and dispensing in liquid form a blend of fluids which fractionate upon vaporization, the method comprising charging the blend of fluids into the first chamber of a container which has an elastic bladder dividing the container into first and second chambers, and charging a pressurizing fluid to the second chamber to maintain the pressure in said first chamber above the bubble point pressure of said liquid.

* * * * *